US005417147A

United States Patent [19]

Mason

[11] Patent Number: 5,417,147

[45] Date of Patent: May 23, 1995

[54] APPARATUS FOR CARBONATING LIQUIDS AT MUNICIPAL WATER PRESSURE

[76] Inventor: Thomas Mason, 1522 Fairfield Beach Rd., Fairfield, Conn. 06430

[21] Appl. No.: 191,023

[22] Filed: Feb. 2, 1994

[51] Int. Cl.[6] ..... B01F 3/04

[52] U.S. Cl. ..... 99/323.2; 261/DIG. 7; 261/64.5; 261/70

[58] Field of Search ..... 99/323.1, 323.2, 323.3, 99/275; 261/DIG. 7, 70, 64.5; 426/474; 422/305, 239

[56] References Cited

U.S. PATENT DOCUMENTS 4,187,262 2/1980 Fessler et al. .
4,225,537 9/1980 Martonffy .
4,298,551 11/1981 Adolfsson et al. .
4,347,783 9/1982 Odgen .
4,482,509 11/1984 Iannelli .
4,509,569 4/1985 Adolfsson .
4,656,933 4/1987 Aschberger et al. .
4,764,315 8/1988 Brusa .
4,850,269 9/1989 Hancock et al. .
4,882,097 11/1989 Shannon .
4,889,662 12/1989 Smith .
4,987,226 1/1990 Hoyle et al. .
5,124,088 6/1992 Stumphauzer ..... 99/323.1
5,192,513 3/1993 Stumphauzer ..... 261/DIG. 7
5,217,621 6/1993 Norris .

*Primary Examiner*—Robert W. Jenkins
*Attorney, Agent, or Firm*—Barry R. Lipsitz

[57] ABSTRACT

Apparatus is provided for automatically carbonating a liquid. A pressure vessel receives carbonating gas at a pressure $P_1$ via a first input, and a supply of liquid at a pressure $P_2$ via a second input. $P_2$ is greater than $P_1$. The flow of liquid into the pressure vessel is restricted, to enable carbonating gas to enter the vessel and substantially reach the pressure $P_1$ therewithin before liquid entering the vessel raises the interior pressure above $P_1$. An output is provided for drawing carbonated liquid out of the pressure vessel. The apparatus is particularly suitable for residential use in providing Seltzer water, where it operates at conventional municipal or private well water pressures.

22 Claims, 2 Drawing Sheets

APPARATUS FOR CARBONATING LIQUIDS AT MUNICIPAL WATER PRESSURE

BACKGROUND OF THE INVENTION

The present invention relates to an apparatus for carbonating liquids such as water, and more particularly to a low cost Seltzer maker for use at municipal water pressure and which is particularly well suited for residential use.

Carbonated water is used in various flavored beverages, and is itself an enjoyable beverage that is commonly referred to as Seltzer water.

Various apparatus for producing carbonated water is well known. Examples can be found in U.S. Pat. Nos. 4,187,262; 4,225,537; 4,482,509; 4,656,933; 4,764,315; and 4,850,269. The '269 patent, entitled "Low Pressure, High Efficiency Carbonator and Method," issued on Jul. 25, 1989 to Hancock et al., includes a good discussion of the various prior art carbonating apparatus and systems. Such prior art devices can be categorized into (i) batch processes in which a pressure vessel needs to be filled with water, pressurized, vented and then used, (ii) large scale commercial devices which produce substantial volumes of carbonated beverages for packaging, and (iii) chemical reaction techniques in which chemicals are added to water to provide carbonation. Commercial carbonating systems generally require electrically driven pumps and/or motors in order to operate. Some systems have been proposed that use liquid carbon dioxide to cool water as it carbonates.

To date, no automatic, economical carbonation apparatus has been provided for producing relatively low volumes of Seltzer water using only municipal water pressure. It would be advantageous to provide such an apparatus.

It would be further advantageous to provide a carbonator that can be easily installed under a sink to provide a faucet for Seltzer water in the home or office. Such an apparatus should be low cost, environmentally safe, reliable, and easy to operate without any need for an external power source.

The present invention provides a carbonator having the aforementioned advantages.

SUMMARY OF THE INVENTION

In accordance with the present invention, apparatus is provided for carbonating a liquid. The apparatus includes a pressure vessel having a first input, a second input and an output. The first input is adapted to couple a source of carbonating gas at a pressure $P_1$ to the interior of the pressure vessel. The second input is adapted to couple a supply of liquid at pressure $P_2$ to the interior of the pressure vessel, where $P_2$ is greater than $P_1$. The output is provided for drawing carbonated liquid out of the pressure vessel. Means are provided for restricting the flow of liquid into the interior of the pressure vessel after carbonated liquid has been drawn therefrom, to enable carbonating gas to enter the vessel and substantially reach pressure $P_1$ therewithin before liquid entering the vessel raises the interior pressure above $P_1$.

The restricting means can comprise an orifice adapted to limit the flow of liquid into the pressure vessel to a trickle. The apparatus can further comprise means for spreading a flow of the liquid within the pressure vessel substantially across a width of the vessel to increase the surface area of the flow that is exposed to the carbonating gas. The spreading means can include a lip over which the flow cascades.

In a preferred embodiment, the interior of the vessel is divided into first and second reservoirs. The first reservoir is adapted to receive and store liquid from the orifice. The second reservoir is adapted to receive liquid overflowing along the spreading means from the first reservoir. The first input is adapted to introduce the carbonating gas into the second reservoir. The apparatus can further comprise a float mounted in the second reservoir. The float is adapted to close the orifice when liquid reaches a predetermined level in the second reservoir that is below the level of liquid in the first reservoir.

In a residential implementation of the invention, the second input is adapted to couple a residential water supply to the pressure vessel. In this instance, the pressure $P_2$ is the normal pressure of the residential water supply, and the pressure $P_1$ can be set to about 40 psi.

An embodiment of the spreading means is provided in which a tray is used to spread the flow of liquid substantially across the width of the pressure vessel. The tray has means for imparting turbulence to the liquid as the liquid passes thereover. For example, the tray can provide channels for introducing turbulence into the liquid flowing therethrough. The provision of such turbulence increases the absorption of carbonating gas into the liquid.

DETAILED DESCRIPTION OF THE INVENTION

The present invention provides an automatic carbonator which operates at municipal water pressure. No pumps, motors or supplemental power sources are required.

Figure 1:
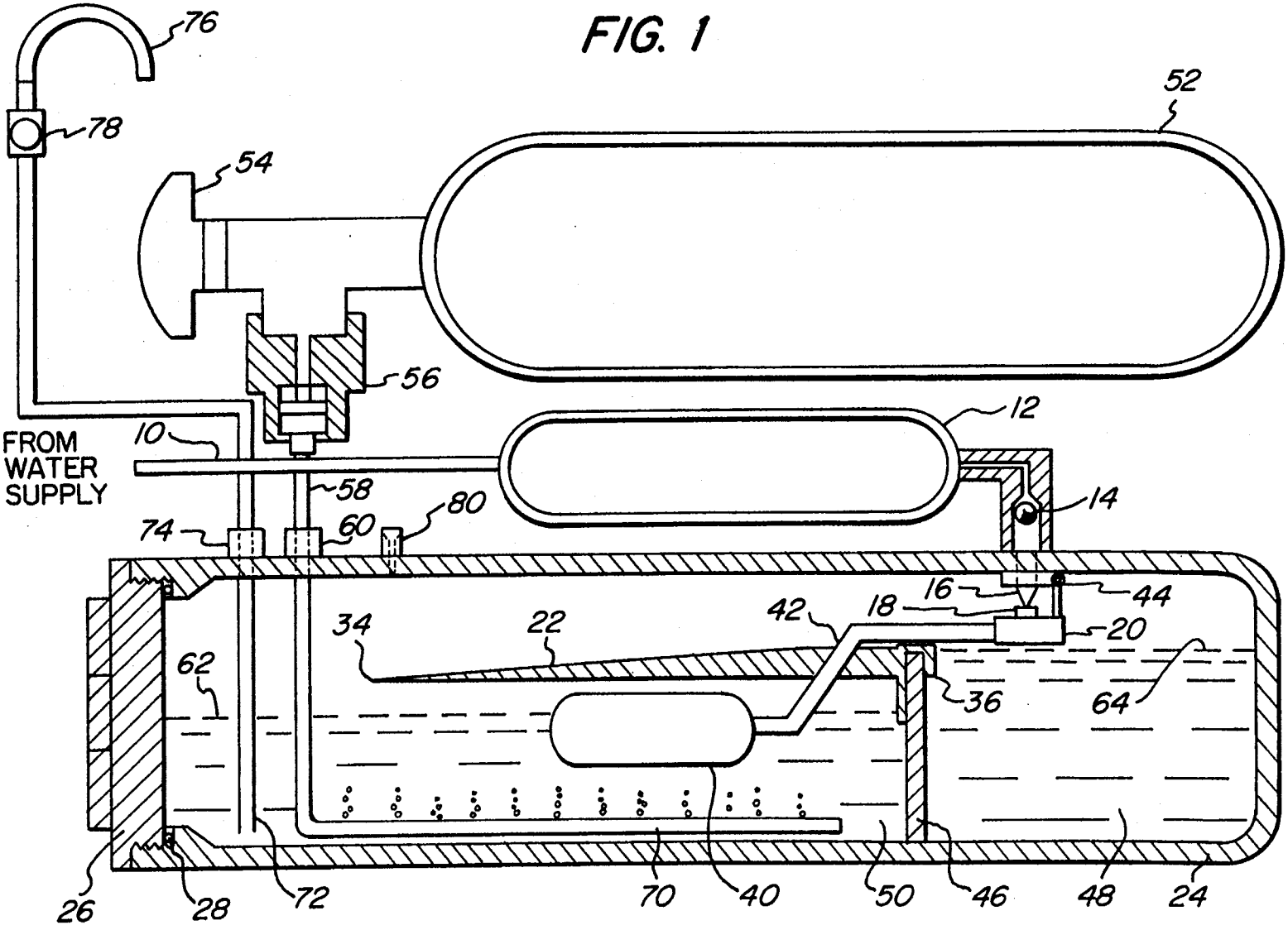
FIG. 1 is a schematic diagram of carbonating apparatus in accordance with the present invention.

Apparatus in accordance with the invention is illustrated schematically in FIG. 1. Water from a municipal water supply or private well is coupled to a supply pipe 10. A filter 12 is provided to remove particulate matter from the water. Filter 12 can be any conventional water filter commonly available for residential use. A filter that includes charcoal can be used to remove undesirable tastes from the supply of water. The filter can also be provided with means for removing bacteriological contamination and/or chemical contaminates such as lead and the like, as well known in the art. The filtered water from filter 12 is passed through a check valve 14 that prevents water from the pressure vessel 24 from flowing back into the water supply.

Pressure vessel 24 is preferably made of plastic having a wall thickness that can support municipal water pressures, which are typically on the order of 50 to 90 pounds per square inch (psi). The pressure vessel is capped at one end with a lid 26 which is threadedly engaged with the pressure vessel. The provision of cap 26 enables the various parts within the pressure vessel to be assembled prior to sealing the vessel. An O-ring 28 provides a water tight pressure seal between pressure vessel 24 and cap 26.

In accordance with the present invention, an orifice 16 is provided at the water supply inlet to pressure vessel 24. Orifice 16 receives water at the municipal or private well water pressure (e.g., 50 psi) from check valve 14, and restricts the flow of water into the interior of the pressure vessel to a trickle. This enables carbonating gas, which enters the pressure vessel via input coupling 60, to substantially reach a first pressure $P_1$ (e.g., 40 psi) before the liquid entering via the orifice 16 raises the pressure inside the pressure vessel above $P_1$ due to the higher municipal or private well pressure $P_2$. In order to accomplish this, orifice 16 is sized to have an opening diameter that will restrict the input water flow to about one ounce or so per minute.

The carbonating gas, such as carbon dioxide ($CO_2$) is supplied from a conventional disposable tank 52. Such tanks are readily available from gas suppliers, such as those that supply the medical industry. Tank 52 is provided with a conventional valve 54 for turning the supply of gas on and off. A regulator 56 regulates the output pressure of the gas, which may be stored in the tank at a pressure of about 700 psi, to an output pressure of about 40 psi. The gas at 40 psi travels from pipe 58 to a perforated gas dispensing tube 70 via input coupling 60.

An output pipe 72 couples carbonated water from the interior of the pressure vessel 24 to a faucet 76 via output coupling 74 and carbonated water supply valve 78. Faucet 76 can be conveniently mounted to a sink (not shown) for the dispensing of Seltzer water using valve 78.

In operation, water flows from the water supply via pipe 10, filter 12, check valve 14 and orifice 16 into pressure vessel 24. The pressure vessel is divided into two reservoirs 48, 50 by a baffle 46. A water tray 22 is mounted to the top of baffle 46 at a first end 36. Tray 22 extends substantially across the width of pressure vessel 24 (i.e., parallel to a diameter of the tubular pressure vessel), and spreads water that overflows from reservoir 48 as it travels to reservoir 50. The water flowing across tray 22 from reservoir 48 will cascade over lip 34 of the tray into reservoir 50. The spreading and cascading of the water provided by tray 22 facilitates the water's absorption of carbonating gas.

Figure 2:
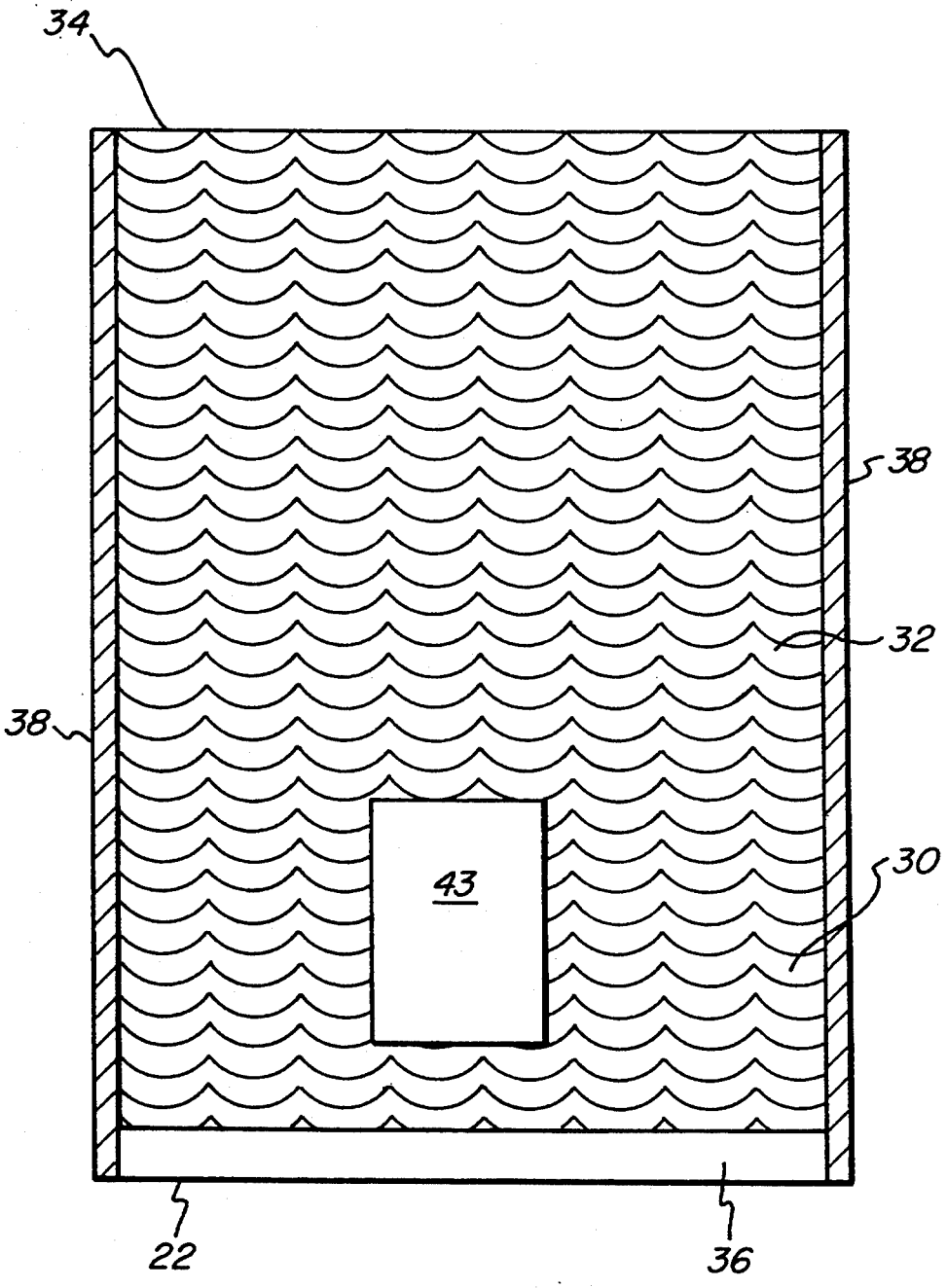
FIG. 2 is a top view of a tray for spreading the flow of liquid and imparting turbulence thereto within the carbonating apparatus.

As illustrated in FIG. 2, tray 22 can optionally be provided with channels 32. The channels are cut into the base 30 of the tray and impart turbulence to the water as it passes through the tray, thereby further facilitating the absorption of carbonating gas into the water. Side walls 38 can be optionally provided on tray 22 in order to contain the water as it travels from input end 36 of the tray to lip 34 thereof. Other techniques for imparting turbulence to the water within tray 22 can also be used, such as providing a plurality of ribs or screens in the tray.

A float 40 is provided to maintain the level 62 of water in reservoir 50 below the level 64 of water in reservoir 48. Float 40 is coupled via arm 42, which passes through an opening 43 in tray 22, to orifice valve assembly 20 which is pivotally mounted at pivot point 44 in order to start and stop the flow of water from orifice 16. A resilient plug 18 (e.g., rubber) is provided in the valve assembly 20 to seal orifice 16 when the water in reservoir 50 reaches a predetermined level.

When the apparatus of the invention is placed into operation, carbonating gas from tank 52 will flow into pressure vessel 24 until it reaches the pressure $P_1$ (e.g., 40 psi) established by regulator 56. At the same time, water will trickle into pressure vessel 24 via orifice 16. Since the water is only trickling into the pressure vessel, it will not reach its full input pressure $P_2$ (e.g., 50–90 psi) before the pressure of the carbonating gas within pressure vessel 24 has already reached pressure $P_1$. The water will continue to trickle into pressure vessel 24 until the interior pressure exceeds $P_1$. Ideally, float 40 will cause valve 20 to shut off the water supply when the pressure inside the vessel is only about five to ten psi above $P_1$. This will allow additional carbonating gas to flow into the vessel after only a little water has been drawn out via faucet 76. If the pressure within the vessel reaches $P_2$ before valve 20 turns the water off, the pressure itself will prevent further water from entering the vessel until the pressure drops therein. A relief valve 80 is provided on the pressure vessel for safety purposes, in case the pressure that the vessel is designed to accommodate is exceeded.

As the water trickles into the pressure vessel, it will first fill reservoir 48. When the water in reservoir 48 reaches level 64, it will begin to overflow across tray 22 and cascade over lip 34 into reservoir 50. Reservoir 50 will then fill until a predetermined water level is reached, causing float 40 to rise and ultimately close orifice 16 via valve assembly 20. The predetermined water level at which float 40 causes orifice 16 to be closed is below level 64 of reservoir 48, and is set such that the water pressure $P_2$ will raise the interior pressure of the pressure vessel 24 at least somewhat above the gas pressure $P_1$.

The water within pressure vessel 24 will absorb carbonating gas while it remains in the vessel. Some absorption of the gas will occur in reservoir 48. More gas will be absorbed as the water flows across tray 22 and cascades over lip 34. The provision of perforations in gas dispensing tube 70 further facilitates the carbonating action as the gas bubbles flow from tube 70, through the water and into the interior of the pressure vessel above the water level. It should be appreciated that since water is only trickling into the pressure vessel via orifice 16, it will flow slowly over the tray 22, maximizing the time that it is exposed in a thin layer to the carbonating atmosphere. The slow flow of water over the tray further enhances the carbonating efficiency of the device.

It should now be appreciated that the present invention provides a low cost, fully automatic apparatus for providing Seltzer water. The apparatus is particularly suitable for residential use, and the components are small enough to easily fit under a kitchen or wet bar sink. For example, pressure vessel 24 can be about 15 inches long and have a diameter of about 4 inches. Preferably, the plastic used for the pressure vessel and for the components contained therein will be of a type conventionally used in water supply systems that will not impart any taste to the water. The inert atmosphere within the pressure vessel provided by the carbonating gas will prevent the water from becoming stale.

As carbonated water is drawn from the pressure vessel 24 via faucet 76, float 40 will drop and open orifice 16 to replenish the water supply. There is some hysteresis in the valve 20, such that a few ounces of carbonated water can be withdrawn from the pressure vessel before new water will start flowing in through the orifice.

Although the invention has been described in connection with a specific embodiment thereof, those skilled in the art will appreciate the numerous adaptations and modifications may be made thereto without departing from the spirit and scope of the invention, as set forth in the claims.

What is claimed is:

1. Apparatus for carbonating a liquid comprising:

a pressure vessel;

a first input for coupling a source of carbonating gas at a pressure $P_1$ to the interior of said pressure vessel;

a second input for coupling a supply of liquid at a pressure $P_2$ to the interior of said pressure vessel, where $P_2 > P_1$;

an output for drawing carbonated liquid out of said pressure vessel; and means for restricting the flow of liquid into the interior of said pressure vessel after carbonated liquid has been drawn therefrom, to enable carbonating gas to enter said vessel and substantially reach said pressure $P_1$ therewithin before liquid entering said vessel raises the interior pressure above $P_1$.

2. Apparatus in accordance with claim 1 wherein said restricting means comprise an orifice adapted to limit the flow of liquid into said pressure vessel to a trickle.

3. Apparatus in accordance with claim 2 further comprising means for spreading a flow of said liquid within said pressure vessel substantially across a width of said vessel to increase the surface area of said flow that is exposed to said carbonating gas.

4. Apparatus in accordance with claim 3 wherein said spreading means include a lip over which said flow cascades.

5. Apparatus in accordance with claim 4 wherein:

the interior of said vessel is divided into first and second reservoirs;

said first reservoir is adapted to receive and stoke liquid from said orifice;

said second reservoir is adapted to receive liquid overflowing along said spreading means from said first reservoir; and said first input is adapted to introduce said carbonating gas into said second reservoir.

6. Apparatus in accordance with claim 5 further comprising a float mounted in said second reservoir, said float being adapted to close said orifice when said liquid reaches a predetermined level in said second reservoir that is below the level of liquid in said first reservoir.

7. Apparatus in accordance with claim 6 wherein said second input is adapted to couple a residential water supply to said pressure vessel and said pressure $P_2$ is the normal pressure of said residential water supply.

8. Apparatus in accordance with claim 7 wherein said pressure $P_1$ is about 40 psi.

9. Apparatus in accordance with claim 1 further comprising means for spreading a flow of said liquid within said pressure vessel substantially across a width of said vessel to increase the surface area of said flow that is exposed to said carbonating gas.

10. Apparatus in accordance with claim 9 wherein said spreading means include a lip over which said flow cascades.

11. Apparatus in accordance with claim 10 wherein:

the interior of said vessel is divided into first and second reservoirs;

said first reservoir is adapted to receive and store liquid from said restricting means;

said second reservoir is adapted to receive liquid overflowing along said spreading means from said first reservoir; and said first input is adapted to introduce said carbonating gas into said second reservoir.

12. Apparatus in accordance with claim 11 further comprising a float mounted in said second reservoir, said float being adapted to close said restricting means when said liquid reaches a predetermined level in said second reservoir that is below the level of liquid in said first reservoir.

13. Apparatus in accordance with claim 12 wherein said second input is adapted to couple a residential water supply to said pressure vessel and said pressure $P_2$ is the normal pressure of said residential water supply.

14. Apparatus in accordance with claim 13 wherein said pressure $P_1$ is about 40 psi.

15. Apparatus in accordance with claim 9 wherein said spreading means comprise a tray having means for imparting turbulence to said liquid as the liquid passes thereover.

16. Apparatus in accordance with claim 15 wherein said tray includes a lip over which said flow cascades.

17. Apparatus in accordance with claim 1 wherein:

the interior of said vessel is divided into first and second reservoirs;

said first reservoir is adapted to receive and store liquid output from said restricting means;

said second reservoir is adapted to receive liquid overflowing from said first reservoir; and said first input is adapted to introduce said carbonating gas into said second reservoir.

18. Apparatus in accordance with claim 17 further comprising a float mounted in said second reservoir, said float being adapted to stop the introduction of liquid into said first reservoir when said liquid reaches a predetermined level in said second reservoir that is below the level of liquid in said first reservoir.

19. Apparatus in accordance with claim 18 wherein said second input is adapted to couple a residential water supply to said pressure vessel and said pressure $P_2$ is the normal pressure of said residential water supply.

20. Apparatus in accordance with claim 19 wherein said pressure $P_1$ is about 40 psi.

21. Apparatus in accordance with claim 1 wherein said second input is adapted to couple a residential water supply to said pressure vessel and said pressure $P_2$ is the normal pressure of said residential water supply.

22. Apparatus in accordance with claim 21 wherein said pressure $P_1$ is about 40 psi.

* * * * *